US007362238B2

(12) United States Patent
Peterson

(10) Patent No.: US 7,362,238 B2
(45) Date of Patent: Apr. 22, 2008

(54) VEHICLE BACK-UP GUIDE

(76) Inventor: Daniel Peterson, P.O. Box 251, Enumclaw, WA (US) 98022

( * ) Notice: Subject to any disclaimer, the term of this patent is extended or adjusted under 35 U.S.C. 154(b) by 211 days.

(21) Appl. No.: 11/160,095

(22) Filed: Jun. 8, 2005

(65) Prior Publication Data

US 2007/0008180 A1 Jan. 11, 2007

(51) Int. Cl.
*B60Q 1/48* (2006.01)

(52) U.S. Cl. ..... 340/932.2; 340/435; 116/63 R; 404/6; 404/7

(58) Field of Classification Search ..... 340/932.2; 116/63 R; 404/6, 7, 14, 16; 49/49
See application file for complete search history.

(56) References Cited

U.S. PATENT DOCUMENTS 4,469,277 A 9/1984 Howes
5,227,785 A * 7/1993 Gann et al. ..... 340/932.2
5,940,012 A * 8/1999 Studebaker ..... 340/932.2
6,147,625 A * 11/2000 Decker ..... 340/933
6,651,581 B2 11/2003 Gauthier
2003/0005876 A1* 1/2003 Boswell ..... 116/63 R
2005/0031820 A1* 2/2005 Gorman ..... 428/40.1

* cited by examiner

*Primary Examiner*—Benjamin C. Lee
*Assistant Examiner*—Eric M. Blount
(74) *Attorney, Agent, or Firm*—David L Tingey

(57) ABSTRACT

A vehicle backing guide for marking a parking area into which a vehicle may be backed, comprising an elongate strap, a plurality of bright segments spaced apart longitudinally along the strap having a high visual contrast with the strap and an indicator member that indicates to the vehicle driver when the vehicle has obtained it preferred position in the parking area. The strap is of length representative of a length of a vehicle to be backed into a parking area therein substantially defining a side boundary of the parking area, the bright segments providing a measure of distance along the strap and hence the parking area, at least a portion of the bright segments being of a same length and mutually spaced apart a same distance longitudinally along the strap, the measure of distance providing the driver an indicator of backing progress into the parking area.

8 Claims, 2 Drawing Sheets

VEHICLE BACK-UP GUIDE

BACKGROUND

1. Field of the Invention

This invention relates to guides to assist one in backing a vehicle such as a trailer or a long vehicle such as a van or a motor home so the vehicle is properly positioned in a preferred area. More specifically, the invention relates to a guide for placement on the ground alongside the area on the driver's side as a demarcation strip terminating in a indicating member that indicates to the driver when to stop backing the vehicle.

2. Prior Art

Problems associated with backing a large or extended vehicle are familiar. The driver is disadvantaged with a limited view behind him and to his right. His depth perception is also compromised by the circumstances so it is difficult to know when to stop backing. The common result is that the driver will place the vehicle largely based on what his sees on his left, or driver's side and estimate when to stop backing. If he misjudges, he moves his vehicle forward and tries again. If he is fortunate, he does not damage his vehicle or other property as he navigates his vehicle rearward.

The difficulty is much improved at least for lateral positioning if a parking stripe is provided on the ground by which the driver can gauge the lateral position of his vehicle. But most parking scenarios do not have such a stripe. The problem with range, or longitudinal, judgment may be overcome by a device that detects and communicates to the driver when the rear of the vehicle reaches a point of detection. Several devices have been proposed. Electronic detectors can trigger an indicator to the driver, but typically, the electronic devices are expensive and complex and not commonly employed. Mechanical devices have been proposed, but they have also been complex with unfavorably pricing and subject to breakage.

The object of the present invention is to provide a vehicle back-up guide that can position the vehicle both longitudinally and laterally in a preferred area. It is a further object that the guide be easily transportable, reducible to compact size for ease of storage. It is another object that the guide be simple in design and construction so it can be cost effective and thus acceptable for wide public use such as for boat trailering and recreational vehicles, beyond just commercial trucking.

SUMMARY

These objects are achieved in a back-up guide comprising an elongate strap of fabric material that may be rolled up tightly for storage but unrolled easily into a horizontal strip for placement as a guide along the side of the parking area in which the vehicle is to be located, without securement to the parking area, prior to backing the vehicle in the parking area, the strap being removable after said vehicle is parked and rollable again for ease of transportability and compact storage.

Spaced apart longitudinally along the strap are bright segments in high visual contrast with the strap. Of equal length and spaced apart with a common pitch, the strap not only provides a clear guide along which to back a vehicle but also a measure of length or distance to a driver whose perception of distance from his driver's seat is characteristically limited. The strap length is representative of a length L of a vehicle, approximately 18 feet is typical, so the strap substantially defines a side boundary of parking area and thus provides a highly visible guide to the vehicle driver. (For these purposes for ease of description, "vehicle" is meant to include a motor vehicle and a trailer hitched to a motor vehicle and a driver of the vehicle is thus deemed to include a driver of a truck or tractor backing a trailer hitched to the motor vehicle.) The strap is of width and weight sufficient to prevent it from twisting when it is laid along a parking area.

At the end of the strap is an indicator member placed to indicate the rearward limit of the area. The indicator member extends from the strap along the rear of the area so when the vehicle is backed into position, the indicator member senses the vehicle and communicates to the driver that the vehicle has reached its rearmost position in the area. The indicator member also reduces to a compact size for ease of storage and transport. The indicator member is deemed to include all devices that communicate to the driver that the vehicle has reached its rearmost position. Such devices include electric indicators, such as a light or horn actuated by a sensor. Such devices also include mechanical indicators, such as a small reflector on a telescoping arm, configured to extend from the strap to a position of impact by the vehicle as it backs into is rearmost position. As the vehicle impacts the arm, the reflector turns, presenting a different reflection to the driver, indicating the impact by the change in the reflection. The reflector may comprise a mirror or a directional reflector. Light reflected by the reflector may be natural ambient light, or it may be artificial light, such as a flashlight on the strap directed at the reflector and reflected to the driver. When the reflector is moved by the vehicle impacting the arm, less light is reflected to the driver and the driver is thus instructed to stop backing. This and many other mechanical and electrical designs and configurations can serve the same purpose, and are deemed included in this invention as alternative embodiments. The indicator members described are given as representative of the several functionally equivalent configurations, all of which are deemed included in the invention.

DETAILED DESCRIPTION OF THE PREFERRED EMBODIMENTS

Figure 1:
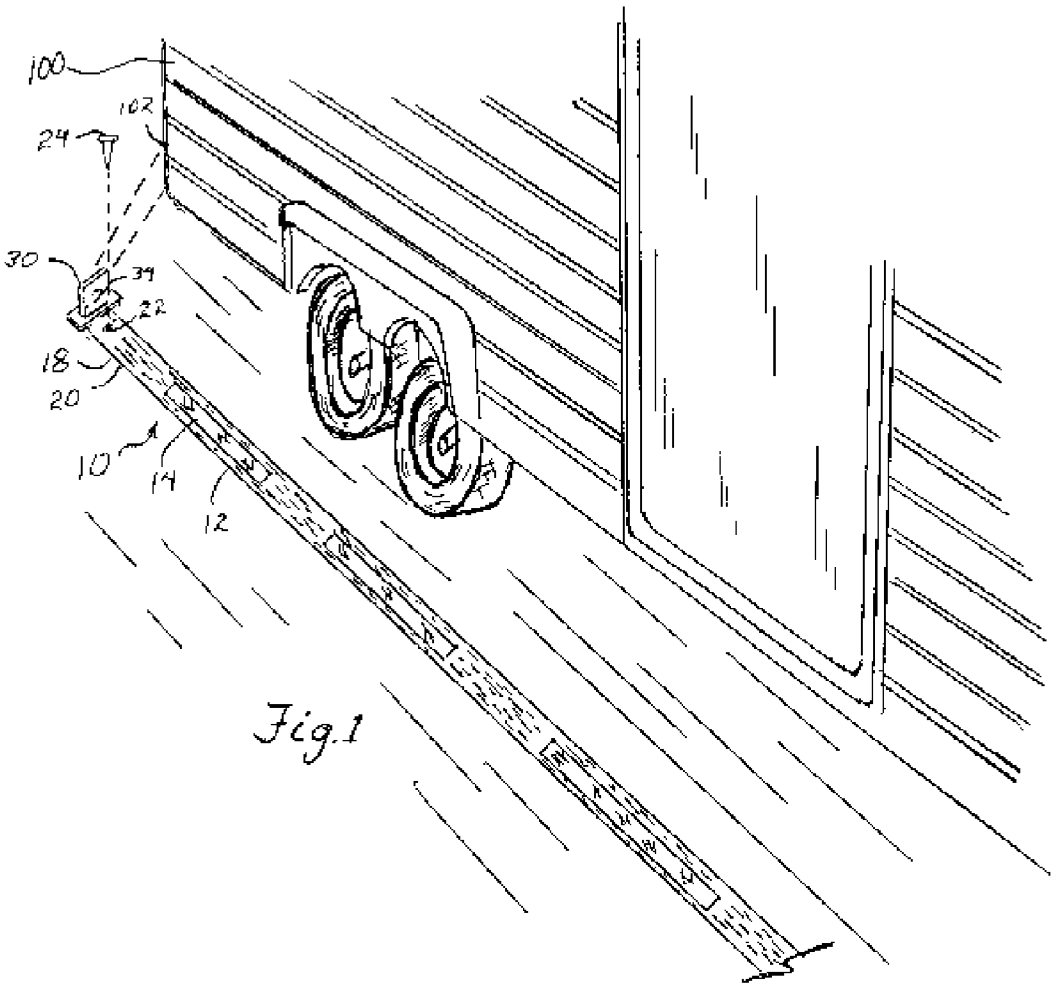
FIG. 1 is a perspective view of the backing guide of the present invention showing the guide strap with bright segments mutually spaced apart longitudinally along the strap and contrasting with the strap for ease of viewing. Also shown is an indicator member at the end of the strap directed forward.
Figure 2:
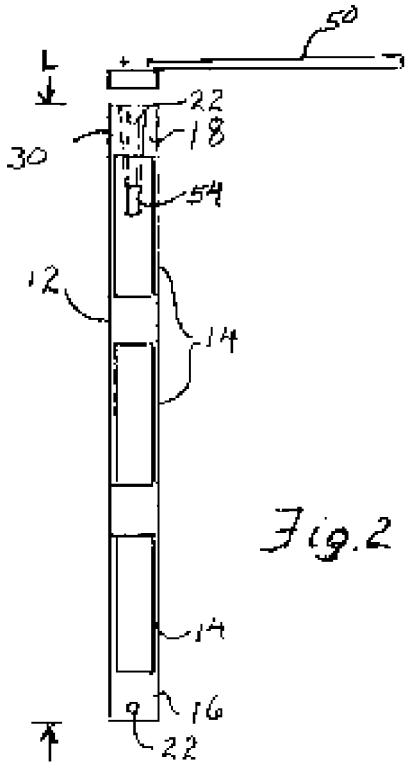
FIG. 2 is a planar top view of the backing guide showing the indicator member at the end of the strap.
Figure 3:
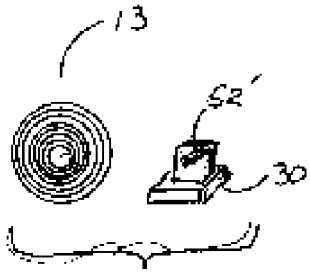
FIG. 3 is a perspective view of the strap and indicator member in compact disposition for storage.
Figure 4:
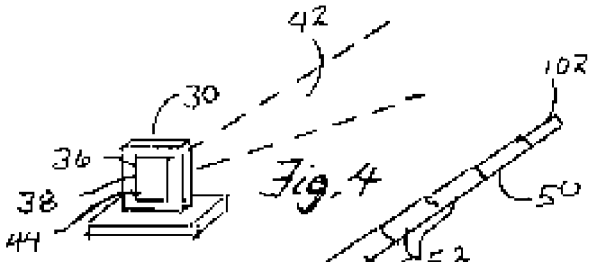
FIG. 4 is a perspective view of the back side of the indicator member showing an electronic sensor on the back of the indicator member directed sidewise and somewhat upward to intersect a vehicle when backed into the path of the sensor.
Figure 6:
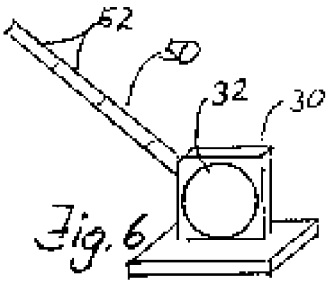
FIG. 6 is a front perspective view of the indicator member of FIG. 5.
Figure 5:
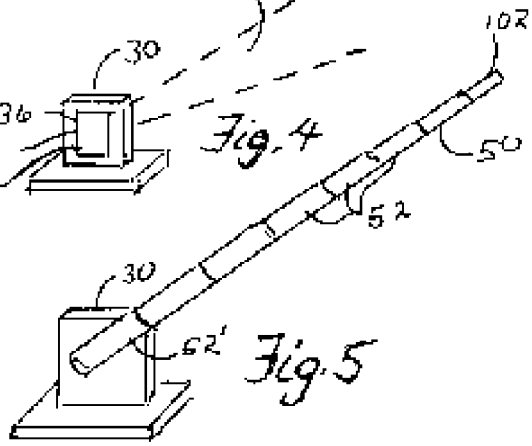
FIG. 5 is a back perspective view of the indicator member in an alternative embodiment employing a telescoping wand extending from the indicator member toward a point of intersection with the backing vehicle.

The vehicle backing guide 10 of the present invention comprises an elongate strap 12 that can be rolled into a tight roll 13 for storage. A plurality of bright segments 14 spaced apart uniformly end to end longitudinally along the strap 12. The bright segments 14 present a high visual contrast with the strap 12 so they are easily distinguished with the strap 12 as a background. For example, the strap 12 may be red or black and the bright segments 14 may be bright yellow or bright orange. The bright segments 14, or subset portion of them, are of equal length and mutually spaced apart a same distance, that is, with a common pitch, such that they serve as a measurement of length and hence relative vehicle position to a driver backing his vehicle 100 along the strap 12. The strap 12 is weighted at its ends 16, 18 to keep it from rising and from twisting. Typically, the strap 12 is sufficiently weighted by folding the strap back on itself a weighting length 20 and securing it to itself. Thus weighted, the strap 12 may be lightweight generally throughout its length but for its weighted ends 16, 18 that maintain the strap 12 flat on the ground. Grommets 22 are located in strap ends 16, 18 to receive a spike 24 to further anchor the strap 12 to the ground.

The backing guide 10 further comprises an indicator member 30 at or near the strap rearward end 18 with a light reflector 32 or light source 34 directed forward, that is, toward the vehicle driver in his driver position. A sensor 36 on the indicator member 30 changes the apparent view of the indicator member 30 to the driver as the sensor 36 detects the presence of the backing vehicle 100 in the presence of the sensor 36.

In a first embodiment, the sensor 36 comprises an electronic sensor 38 configured to detect the presence and absence of the backing vehicle 100. The electronic sensor 38 is connected to turn on the light source 34 when the vehicle 100 is backed into the sensing field 42 of the sensor 38. A battery pack 44 is included with the indicator member 10 to power the sensor and light source. The driver then backs the vehicle in parallel alignment with the strap 12 and continues backing until he sees light from the light source 34, indicating that the vehicle 100 has intersected the field 42 of the sensor 38.

In a second embodiment, the sensor 38 comprises a mechanical arm 50 extendable from the reflector 32 outward toward an anticipated point of intersection 102 with the backing vehicle 100 such that when the vehicle 100 impacts the arm 50, the reflector 32 moves from an initial position forward toward the driver. A different reflection is then presented to the driver who may thus recognize that the vehicle has backed into the arm 50 and stop backing. For storage convenience the arm 50 comprises a plurality of mutually telescoping members 52 extending to the point of intersection 102 when deployed for use and collapsing into an arm outer member 52' for storage. The reflector 32 may be a mirror or a directional reflector. To present a positive recognizable light signal to the driver, the reflector 32 may be illuminated by a illuminating source 54 on or near the strap 12 so when the reflector 32 moves it no longer reflects light from the illuminating source 54 back to the driver.

What is claimed is:

1. A vehicle backing guide for marking a parking area into which a vehicle may be backed during parking of the vehicle, comprising a rollable elongate strap adapted to be temporarily unrolled into a horizontal strip and placed onto the parking area as a guide along the side of the parking area in which the vehicle is to be located, without securement to the parking area, prior to backing the vehicle in the parking area, the strap being removable after said vehicle is parked and rollable again for ease of transportability and compact storage, a plurality of bright segments spaced apart uniformly longitudinally along the strap having a high visual contrast with the strap.

2. The vehicle backing guide of claim 1 wherein the strap is of length representative of a length of the vehicle to be backed into the parking area therein substantially defining a side boundary of the parking area.

3. The vehicle backing guide of claim 1 wherein the bright segments comprise a measure of distance along the strap, at least a portion of the bright segments being of a same length and mutually spaced apart a same distance longitudinally along the strap.

4. The vehicle backing guide of claim 1 wherein the strap comprises ends of weight greater than between said ends.

5. The vehicle backing guide of claim 1 wherein the strap is of length representative of a length of a vehicle to be backed into a parking area therein substantially defining a side boundary of the parking area and wherein the bright segments comprise a measure of distance along the strap and hence the parking area, at least a portion of the bright segments being of a same length and mutually spaced apart a same distance longitudinally along the strap, the measure of distance providing the driver an indicator of backing progress into the parking area.

6. The vehicle backing guide of claim 1 further comprising an indicator member on or near the strap sensing when the vehicle is at a preferred position in the parking area.

7. The vehicle backing guide of claim 1 wherein the strap is of fabric material that may be rolled up tightly for storage but unrolled easily into a horizontal strip for placement as a guide along the side or the parking area.

8. A vehicle backing guide for marking a parking area into which a vehicle may be backed during parking of the vehicle, comprising a rollable elongate strap adapted to be temporarily unrolled without attachment onto the parking area prior to backing the vehicle in the parking area by only unrolling the strap onto the parking area, the strap being removable after said vehicle is parked and rollable again for ease of transportability and compact storage a plurality of bright segments spaced apart uniformly longitudinally along the strap having a high visual contrast with the strap.

* * * * *